US005554068A

United States Patent [19]

Carr et al.

[11] Patent Number: 5,554,068

[45] Date of Patent: Sep. 10, 1996

[54] ABRASIVE FLAP BRUSH AND METHOD AND APPARATUS FOR MAKING SAME

[75] Inventors: Jeanne M. Carr, Menomonie, Wis.; Jeffrey R. Clampitt, Lino Lakes; Dean R. Zimmerman, Falcon Heights, both of Minn.

[73] Assignee: Minnesota Mining and Manufacturing Company, Saint Paul, Minn.

[21] Appl. No.: 354,952

[22] Filed: Dec. 13, 1994

[51] Int. Cl.[6] ..... B24B 9/02

[52] U.S. Cl. ..... 451/468; 451/466; 451/469; 451/532; 451/526; 451/533; 451/537; 51/297

[58] Field of Search ..... 451/466, 468, 451/469, 526, 532, 533, 537

[56] References Cited

U.S. PATENT DOCUMENTS

| | | | |
|---|---|---|---|
| 2,913,857 | 6/1957 | Reed et al. | 451/466 |
| 2,958,593 | 11/1960 | Hoover et al. . | |
| 3,406,488 | 10/1968 | Rykken . | |
| 3,548,550 | 12/1970 | McAleer | 451/466 |
| 3,548,551 | 12/1970 | Block | 451/469 |
| 3,561,173 | 2/1971 | Block | 451/466 |
| 3,645,049 | 2/1972 | Freerks et al. . | |
| 3,699,727 | 10/1972 | McDonald . | |
| 3,706,167 | 12/1972 | Schaffner | 451/466 |
| 3,795,498 | 3/1974 | Hasegawa | 451/466 |
| 4,090,333 | 5/1978 | Block et al. | 451/468 |
| 4,258,509 | 3/1981 | Wray et al. | 451/468 |
| 4,275,529 | 6/1981 | Teetzel et al. . | |
| 4,872,292 | 10/1989 | Block | 451/533 |
| 4,882,879 | 11/1989 | Warner et al. | 451/466 |
| 5,247,740 | 9/1993 | Curtis et al. . | |
| 5,424,718 | 6/1995 | Tyler et al. | 451/466 |

FOREIGN PATENT DOCUMENTS

| | | | |
|---|---|---|---|
| 59-175959 | 3/1983 | Japan | 451/466 |

OTHER PUBLICATIONS

UK Patent Application 2270487 Rotary abrading tool having strip abrading elements Mar. 16 1994.

*Primary Examiner*—Bruce M. Kisliuk
*Assistant Examiner*—George Nguyen
*Attorney, Agent, or Firm*—Gary L. Griswold; Walter N. Kirn; James J. Trussell

[57] ABSTRACT

An abrasive flap brush including a central core, a layer of adhesive disposed on the peripheral surface of the core by a coater, and a plurality of abrasive flaps adhered to the core by the adhesive. The adhesive is uniformly distributed around the core by providing either the core or the adhesive coater with spacing projections that maintain a predetermined minimum distance between the coater and the core when the adhesive is applied. A coater including the spacing projections is also disclosed, as is a method for making an abrasive flap brush.

39 Claims, 5 Drawing Sheets

ABRASIVE FLAP BRUSH AND METHOD AND APPARATUS FOR MAKING SAME

TECHNICAL FIELD

The present invention relates to an abrasive flap brush having a central core to which is adhered a plurality of abrasive flaps, and more particularly to a means, process, and apparatus for providing an adequately uniform layer of adhesive to the central core to adhere substantially all of the flaps.

BACKGROUND OF THE INVENTION

Abrasive flap brushes are surface conditioning tools that include a central core and a plurality of radially extending strips, or flaps, of abrasive material. The abrasive flaps are each adhered to the core at one end of the flap, such that an opposed end of each flap is presented for contact with a workpiece surface when the core is rotated. Flap brushes of this construction are useful in the surface preparation and conditioning of metals, wood, plastics, and other materials to prepare the surface for painting, plating, or other subsequent processes. Flap brushes are also useful for imparting a desired finish to a surface of a workpiece.

FIG. 1 is a perspective view of a conventional flap brush 10, including a cylindrical central core 12, a layer of adhesive 16 coated on the outer peripheral surface 14 of the core, and a plurality of radially extending abrasive flaps 18. The cylindrical core 12 is typically a paper and phenolic resin composite or a polyester and glass fiber composite. The adhesive 16 may be, for example, an epoxy, and is coated over the outer surface 14 of the core to adhere the abrasive flaps 18 to the core 12. The abrasive flaps 18 may be nonwoven materials comprising staple fibers, abrasive particles, and a curable binder for bonding the particles to the nonwoven fibers. Flaps 18 are adhered at core end 20 to core 12 by the adhesive layer 16. The flaps 18 extend radially outwardly from the core 12, and are typically tightly packed to minimize relative movement between adjacent abrasive flaps. For example, in an abrasive flap brush having a 15.2 cm (6 in) outer diameter and including one hundred and twenty eight nonwoven abrasive flaps, the flaps 18 can be compressed at the core end 20 to approximately 10% of their uncompressed thickness and at their outer end 22 to about 30% of their uncompressed thickness. In this arrangement, the outer ends 22 of each of the abrasive flaps together form a flap brush outer peripheral surface 24, which may be rotatively applied to a workpiece surface. An example of a flap brush 10 of the foregoing general construction is available from the Minnesota Mining and Manufacturing Company of St. Paul, Minn. under the designation Scotch-Brite™ Flap Brush and is shown in FIG. 1.

The flap brush 10 shown in FIG. 1 is typically constructed by coating adhesive 16 over the outer surface 14 of a long central core 12 which can be 1.42 meters (56 in) long, for example, using art adhesive coater 50 as seen in FIG. 2. Coater 50 includes a cylindrical bore 52 having an inner diameter at wall 54 that is somewhat larger than the outer diameter of the core resulting in a gap 56 between the outer surface 14 and wall 54. Enough adhesive 16 to coat the core is held in funnel portion 58 of coater 50. Valve 60 can be moved in the opposing directions indicated by arrow A, and initially rests against the inner wall of the funnel 58 where it joins the bore 52. This prevents the adhesive from flowing into the space 56 between the bore wall 54 and the core 12. When valve 60 is lifted away from the wall of the funnel portion 58 to its open position, adhesive flows into space 56 between core 12 and bore wall 54, and bonds to outer surface 14 of core 12. Any suitable known means for maintaining the valve 60 in its open position may be used such as a pin and groove interlock with a frame member (not shown). The first end 13 of core 12 is moved in direction B through the bore such that the adhesive is progressively applied to outer surface 14 along the full length of the core to second end 15 in a relatively uniform manner. The longitudinal axis 11 of core 12 must be maintained sufficiently concentric relative to the longitudinal axis 53 of the bore of the coater, and the shape of the core must not be excessively out-of-round. In this manner, a sufficiently uniform coating of adhesive 16 will be applied around the entire outer surface 14 of the core 12 to adequately adhere substantially all of the core ends 20 of the abrasive flaps 18 to the core. In an attempt to maintain the core 12 concentric with the bore 52 of the coater, the inner wall 62 of valve 60 may be sized to be as close as possible in diameter to the outer surface 14 of the core, allowing for manufacturing tolerances, while still allowing the core 12 to pass through the valve 60. The valve 60 is then held by a suitable frame member (not shown) to be concentric to the bore 54, to keep the core 12 concentric with the bore 54.

After the adhesive has been applied to the core 12 by the coater, a plurality of abrasive flaps 18 which can be 1.32 meters (52 in) long, 5.08 cm (2 in) wide, and 1.27 cm (0.5 in) thick, for example, are compressed inwardly toward the core 12 to contact the adhesive 16. The long abrasive flaps 18 may be placed in contact with the adhesive 16 on the core 12 one after another, or more typically may be collectively compressed against the adhesive 16 until the adhesive cures. When the adhesive has cured sufficiently to retain the abrasive flaps 18, the long assembled abrasive flap brush may be cut transverse to the length of the core to provide a plurality of abrasive flap brushes 10 of any suitable width. Each flap brush may have a width of, for example, 2.54 cm (1.0 in). The final width of the flap brush 10 can be chosen with respect to the particular desired application of the flap brush.

When fabricating conventional flap brush 10, it has been observed that it is not always possible to maintain the core 12 concentric relative to the bore of the adhesive coater for all or a portion of the length. Even when the valve inner wall 62 is sized to guide the core 12, it is not possible to always maintain desired concentricity. This can be caused, for example, by tolerances between the core outer surface and the valve inner wall 62 and by tolerances between the valve 60 and the bore 52. These tolerances can allow the core to be non-concentric relative to the bore, and this can be aggravated by the distance between the bottom of valve 60 and the top of the bore 52 when the valve is moved to its open position. Additionally, the core 12 may exhibit excessive out-of-roundness along all or a portion of the length of the core. Either or both of these conditions can cause a portion of the outer surface 14 of the core to come too close to or contact the wall of the bore of the adhesive coater as illustrated at C in FIG. 3. Under these conditions, the adhesive layer 16 may not have uniform thickness around the circumference of the core or along the length of the core, or both. When the adhesive layer 16 is not uniformly distributed over the outer surface 14 of core 12, those flap brushes **18*a* that contact little or no adhesive coating on the core are not adequately adhered to the core, and may leave a gap 26 between outer surface 14 and core end 20 of flaps 18*a* as seen in FIG. 4. The compressive force between adjacent abrasive flaps 18 and 18*a* may be insufficient to maintain unadhered abrasive flaps 18***a* on the flap brush 10, thereby reducing the effectiveness and life of the flap brush.

It is therefore desirable to provide an abrasive flap brush with a core having a sufficiently uniform coating of adhesive and a method and apparatus for making an abrasive flap brush having a uniform layer of adhesive disposed on the core to ensure adequate adhesion of the abrasive flaps to the core.

SUMMARY OF THE INVENTION

One aspect of the present invention includes a method of making an abrasive flap brush comprising the steps of: a) providing a central core including an outer surface, a first end, and a second end; b) placing said first end of said core in a coater including a bore, said bore including an inner wall configured to extend around said outer surface; c) introducing adhesive into said bore; d) moving said core from said first end to said second end through said bore thereby coating said outer surface with said adhesive; and e) adhering a plurality of abrasive flaps to said core with said adhesive; wherein at least one of said outer surface and said inner wall includes a spacing means for maintaining a predetermined minimum distance between said outer surface and said inner wall.

Another aspect of the present invention includes an abrasive flap brush of the type including a core having a layer of adhesive applied by the operative surface of a coater, said abrasive flap brush comprising a core including an outer surface; a layer of adhesive provided on said outer surface; and a plurality of abrasive flaps adhered to said core by said layer of adhesive; wherein said core includes spacing means on said outer surface for maintaining a predetermined minimum distance between said core outer surface and the operative surface of the coater thereby allowing a sufficiently uniform layer of said adhesive to be applied to said outer surface such that substantially all of said abrasive flaps are adhered to said core.

A further aspect of the present invention includes a coater for applying adhesive to the outer surface of a core passed therethrough, said coater comprising a bore including an inner wall configured to extend around the outer surface of the core; adhesive supply means for providing adhesive to said bore; and spacing means provided on said inner wall for maintaining a minimum predetermined distance between said inner wall and the outer surface of the core.

A yet further aspect of the present invention includes a core of the type including an outer surface for receiving a layer of adhesive applied by the operative surface of a coater, said core comprising an outer surface and spacing means on said outer surface for maintaining a predetermined minimum distance between said core outer surface and the operative surface of the coater.

BRIEF DESCRIPTION OF THE DRAWINGS

The present invention will be further explained with reference to the appended Figures, wherein like structure is referred to by like numerals throughout the several views, and wherein.

DETAILED DESCRIPTION OF THE INVENTION

Figure 1:
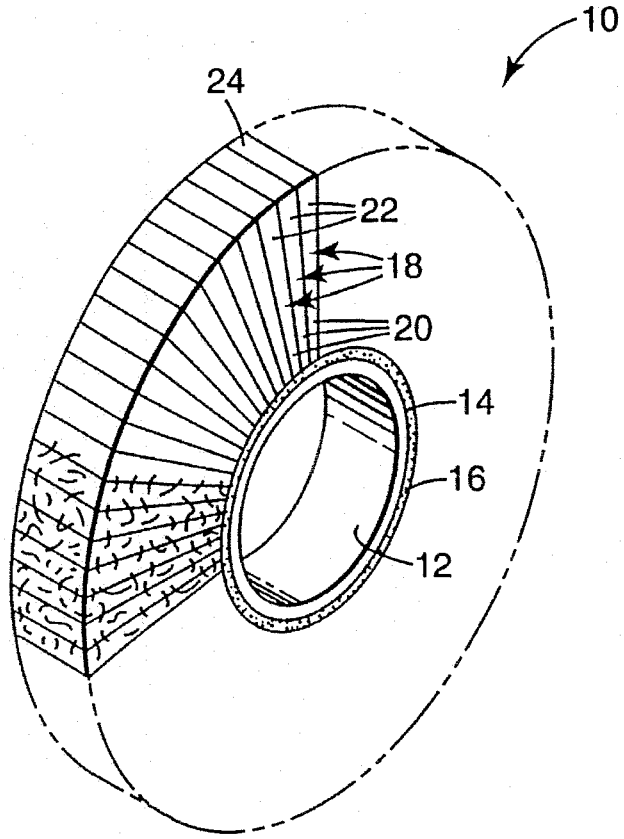
Fig. 1 PRIOR ART
FIG. 1 is an isometric view of a conventional abrasive flap brush.
Figure 4:
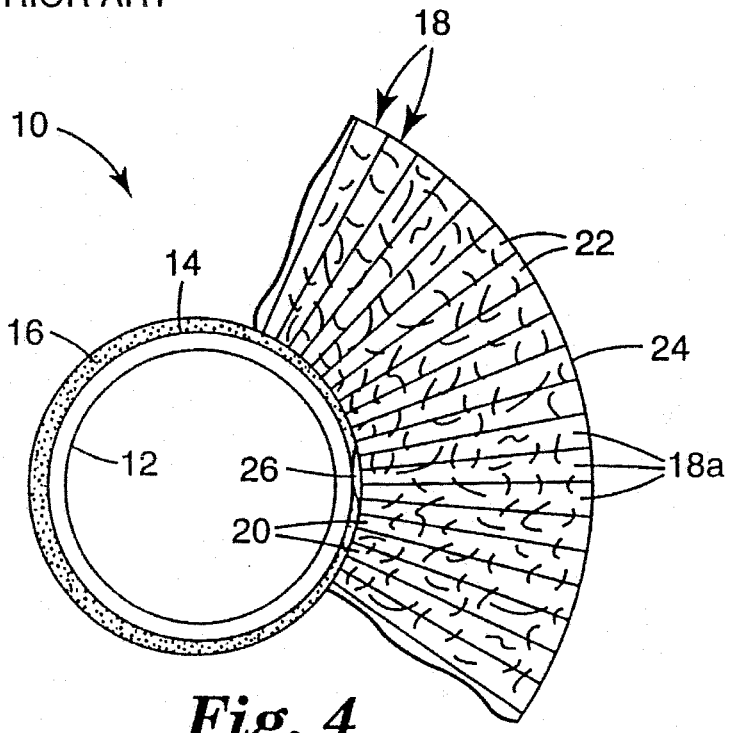
Fig. 4 PRIOR ART
FIG. 4 is a partial cross-sectional view of a conventional abrasive flap brush wherein the adhesive has not uniformly applied to the core.
Figure 2:
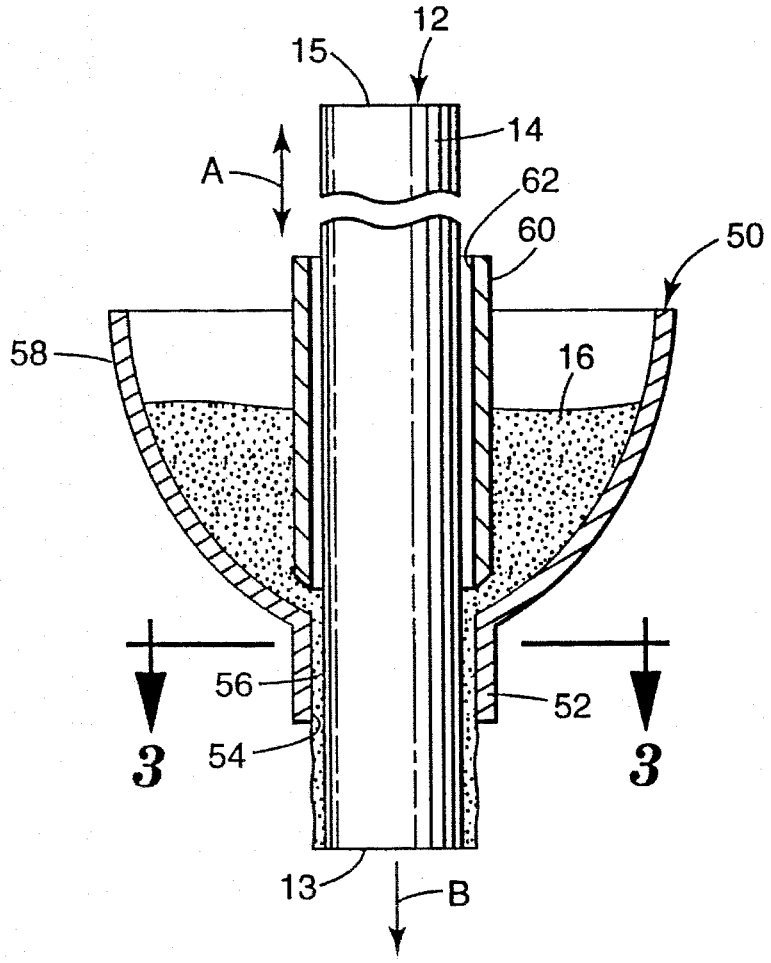
Fig. 2 PRIOR ART
FIG. 2 is a partial cross-sectional view of a conventional flap brush core and adhesive coater.
Figure 3:
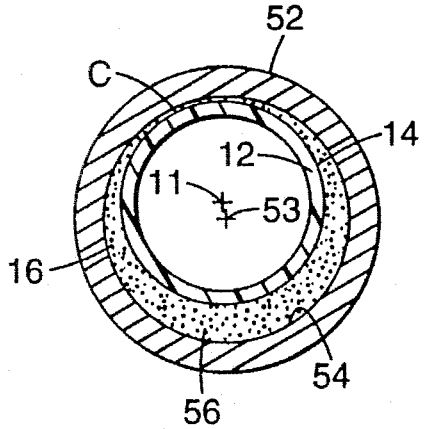
Fig. 3 PRIOR ART
FIG. 3 is a cross-sectional view of the core and coater of FIG. 2 taken along line 3—3.

The present invention includes an abrasive flap brush including a central core, a substantially uniform layer of adhesive disposed on the outer surface of the core, and a plurality of abrasive flaps adhered to the core by the adhesive. The present invention also includes a method and apparatus for making such a flap brush. In a first embodiment of the invention, the core is provided with spacing projections that project radially from the outer surface of the core. When the core is drawn through a bore of an adhesive coater to have the adhesive applied thereto, the spacing projections maintain the outer surface of the core a minimum distance from the wall of the bore, so that sufficient adhesive is provided over substantially the entire outer surface of the core. In a second embodiment of the invention, the bore of the adhesive coater includes spacing projections for guiding the core through the coater bore. In a manner similar to the operation of the spacing projections of the core in the first embodiment, the spacing projections of the bore maintain a predetermined distance between the wall of the bore and the outer surface of the core. This spacing ensures adequately uniform distribution of adhesive over the core. Thus, the abrasive flaps are consistently adhered to the core by a suitable amount of adhesive, in contrast to conventional abrasive flap brushes.

The abrasive flap brush of the present invention may be constructed with any suitable components as known in the art. The core may comprise materials including, but not limited to, metal such as aluminum; plastics such as nylon 6,6; or composites such as polyester/glass fiber composites or phenolic/paper composites. The core is preferably a hollow cylindrical core, but other types of cores are also contemplated. For instance, the core may be solid rather than hollow. Also, it may be possible to use a core having a non-circular cross-section in applications where work pieces are moved relative to the flap brush.

The adhesive may be any suitable adhesive, including but not limited to pressure sensitive adhesives, curable epoxies, phenolics, silicones, acrylics, and styrene-butadiene copolymers. One preferred adhesive is an epoxy having a cure time of about 30 minutes or less, commercially available from Minnesota Mining and Manufacturing Company, St. Paul, Minn., under the trade designation Scotch-Weld™ Brand 3501 B/A Epoxy Adhesive. Another preferred adhesive is a mixture of the following components: 500 parts of Shell Epon® Resin 828 (bisphenol A/epichlorohydrin based epoxy resin) available from Shell Oil Co., Houston, Tex.; 500 parts of D.E.N.® 438 Epoxy Novolac (polymers of epichlorohydrin, phenol-formaldehyde novolac) available from Dow Chemical, U.S.A., Midland, Mich.; 1000 parts of Capcure 3-800 (mercaptan polymer) available from Henckel Corporation, Ambler, Pa.; and 30 parts Capcure EH-30 (2,4,6,-tri (dimethylaminomethyl) phenol) also available from Henckel Corporation.

The nonwoven abrasive flaps may comprise a staple fiber such as nylon, polyester or polypropylene; a curable binder such as phenolic, epoxy, acrylic, or polyurethane; and abrasive particles that are bonded to and between the fibers by the binder such as silicon carbide, aluminum oxide, talc, flint, or a ceramic aluminum oxide composition available from Minnesota Mining and Manufacturing Company, St. Paul, Minn. under the designation Cubitron™. Examples of suitable nonwoven abrasive flap materials are disclosed in U.S. Pat. No. 2,958,593 (Hoover et al.), the entire disclosure of which is incorporated herein by reference. Suitable material for the abrasive flaps is commercially available from Minnesota Mining and Manufacturing Company, St. Paul, Minn., under the trade designation Scotch-Brite™. The abrasive flaps may also comprise coated abrasive flaps, or a combination of coated abrasive and nonwoven abrasive flaps.

FIGS. 5–7 and 9 illustrate one embodiment of a flap brush 110 in accordance with the present invention and an apparatus 150 for coating the core of the abrasive flap brush core in accordance with the present invention. Flap brush 110 includes core 112 which has an outer surface 114 and is preferably cylindrical and hollow, as shown, but could instead be solid and/or non-cylindrical. The outer diameter of core 112 may be any suitable dimension, and core outer diameters of between 1.91 cm (0.75 in) and 30.5 cm (12 in) have been found to have utility. The length of core 112 may also be any suitable dimension, and core lengths of between 63 cm (25 in) and 230 cm (90 in) have been found to have utility. When a relatively long core is used to make an abrasive flap brush, the assembled flap brush can be cut transverse to the core to provide a plurality of smaller abrasive flap brushes. Thus, an assembled abrasive flap brush measuring 132 cm (52 in) long may be sectioned into a plurality of 2.54 cm (1.0 in) wide, or 1.27 cm (0.5 in) wide individual flap brushes, for example.

Spacing means are provided to maintain a minimum distance between the outer surface of the core and the wall of the bore of the adhesive coater as the core is moved through the coater to apply adhesive progressively along the length of the core. Maintaining this minimum distance ensures a sufficient layer of adhesive is applied to the outer surface of the core to adequately adhere substantially all of the abrasive flaps to the outer surface of the core.

Figure 6:
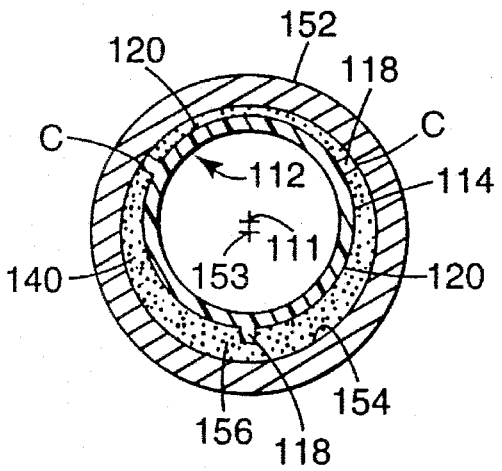
FIG. 6 is a cross-sectional view of the core and coater of FIG. 5 taken along line 6—6.

In the first embodiment, the spacing means comprises radially projecting and axially extending spacing projections 118 extending from the outer surface 114 of the core 112. As seen in FIG. 6, projections 118 can comprise three evenly angularly spaced, rectangular extensions of the outer surface 114 of core 112. In one preferred embodiment, projections 118 are each approximately 3.2 mm (0.125 in) wide in the circumferential direction, 1.6 mm (0.063 in) high in the radial direction, and extend for the full length of a 1.42 meter (56 in) long core. The cylindrical core 112 can preferably have an inner diameter of 5.1 cm (2 in) and an outer diameter at surface 114 of 6.0 cm (2.375 in). Adhesive 140 is applied by the adhesive coater 150, and the spacing projections 118 ensure that a predetermined minimum distance between the outer surface 114 of the core 112 and wall 154 of the adhesive coater 150 is maintained at all times during the coating process. If the full length or any portion of the core is not concentric with the bore, and/or if the core is out-of-round, the spacing projections 118, and not the outer surface 114 of the core, contact the side wall 154 of the coater bore 152 as seen at C in FIG. 6. Thus, adhesive 140 is provided over substantially the entire outer surface 114 of the core 112.

The spacing projections 118 are provided on the outer surface of the core during fabrication of the core. The projections may be integrally formed on the outer surface by molding a core with the desired projections. The core may also be fabricated integrally with the spacing projections by extrusion or pultrusion as is known in the art. Alternatively, the projections may be added to the core by adhesively or mechanically attaching the projections on a core. It is also possible to cut away or otherwise remove portions of the outer surface of a core to leave the desired projection. This can be accomplished by standard milling and machining techniques or by the use of a cutting method like that described in U.S. Pat. No. 5,247,740, Method and Apparatus for Cutting a Keyway in a Mill Roll (Curtis et al.), the entire disclosure of which is incorporated herein by reference.

Figure 5:
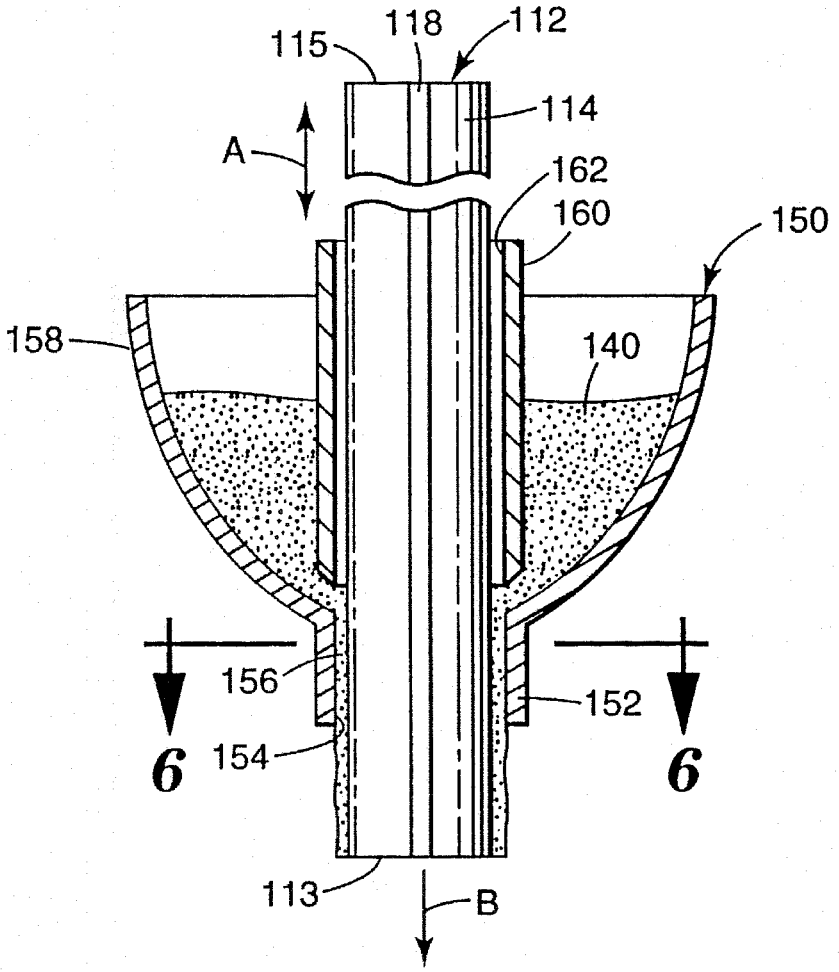
FIG. 5 is a partial cross-sectional view of a first embodiment of an abrasive flap brush core and adhesive coater constructed in accordance with the present invention.

Adhesive 140 is applied to the core 112 as follows. Core 112 is disposed within cylindrical bore 152 of adhesive coater 150 with first end 113 of the core inserted first. In the illustrated embodiment, the spacing means takes the form of three rectangular spacing projections 118 evenly spaced about the outer surface 114 of the core 112 to maintain a predetermined minimum distance between the core and the wall 154 of the bore. As seen in FIGS. 5–6, the adhesive coater 150 includes a cylindrical bore 152 and a funnel portion 158 which is sized to hold a sufficient amount of adhesive 140 to coat core 112. Valve 160 is hollow, and inner wall 162 is sized to accept core 112 within the valve. As explained above, it is desirable to maintain the longitudinal axis 111 of the core concentric with the longitudinal axis 153 of the bore. The inner wall 162 of the valve 160 may be approximately the same diameter as the outer diameter of the spacing projections of the core to guide the core 112 through the bore 152 as described above. Valve 160 may be moved in the opposing directions indicated by arrow A, and initially rests against the inner wall of the funnel portion 158 where it joins the bore 152. This prevents the adhesive from flowing into the space 156 between the bore wall 154 and the core 112. When valve 160 is lifted away from the space 156 to its open position, adhesive 140 can flow into the space 156 while core 112 is moved in direction B through the bore 152 to be coated with adhesive progressively along its entire length starting at first end 113 and continuing to second end 115. The valve 160 may be maintained in its open position by any suitable known means such as a pin and groove engagement with a frame member (not illustrated). Core 112 should be moved through the bore at a rate which provides adequate coating of adhesive 140, and a rate of approximately 0.3 m/see (1 ft/sec) has been found useful. Adhesive 140 fills the space 156 between core 112 and the wall 154 of bore 152, and bonds to the outer surface 114 of the core 112. Wall 154 thereby acts as the operative surface of coater 150 for applying the adhesive 140 to outer surface 114.

As the core 112 is drawn through bore 152, the adhesive 140 bonds to the core and is drawn out of the gap 156 with the core. Adhesive 140 in the funnel portion 158 will continuously flow into the gap 156 to replace the adhesive bonded to the portion of the core which has exited the bore. When the valve 160 is in its open position, it should provide an adequate opening to allow sufficient adhesive 140 to flow into the gap 156. A space of approximately 1.9 cm (0.75 in) between the bottom of the valve 160 and the inner wall of the coater 150 has been found useful in this regard.

In one preferred embodiment, the coater 150 is held stationary and the core 112 is passed through the bore 152 until the entire outer surface 114 of the core 112 has been coated with adhesive 140. Other forms of relative motion between the core 112 and the adhesive coater 150 are also contemplated, such as holding the core 112 stationary and moving the coater 150, and moving both the coater 150 and the core 112. The coater described herein is illustrative of a preferred coater having an operative surface for coating adhesive onto the outer surface of the flap brush core of the present invention. However, the present invention is not so limited, and the flap brush core of the present invention may have adhesive 140 applied by any suitable means having an operative surface for applying adhesive to the outer surface of the core. For example, the coater need not encompass the entire circumference of the core and may instead apply adhesive to one segment of the circumference of the core at a time.

After the outer surface 114 of the core 112 has been coated with adhesive 140, the abrasive flap brush 110 may be assembled by pressing abrasive flaps 130 into the adhesive layer 140 disposed on the core 112 and holding the flaps in place until the adhesive has set. Each abrasive flap 130 includes a core end 132 and an abrading end 134. When the abrasive flaps 130 have been adhered to the core 112, the abrading ends 134 together form a uniform peripheral abrading surface 136 of the abrasive flap brush 110. When core 112 is of the dimensions described above, it has been found useful to apply one hundred and twenty-eight nonwoven abrasive flaps 130 to the core. Each flap can be 1.27 m (50 in) long, 5.08 cm (2 in) wide, and 1.27 cm (0.5 in) thick.

The abrasive flaps 130 may be pressed into the adhesive 140 seriatim, or may be arranged and pressed into the adhesive collectively as shown in U.S. Pat. No. 4,275,529, High Flap Density Abrasive Flap Wheel (Teetzel et al.), the entire disclosure of which is incorporated herein by reference. In such a method as disclosed in U.S. Pat. No. 4,275,529, a sufficient number of flaps for the entire wheel are stacked side by side in a row with outer end 134 of each flap positioned face down. The entire stack is compressed by a press or other suitable means until the compressed length is equal to the final assembled circumference at core end 132 of the flaps. The core ends 132 are maintained in this compressed state by placing a suitable holding means on the core ends of the flaps, such as a strip of adhesive resin or a strip of adhesive tape. The flap assembly is then released from the press and flexed about the core and held against adhesive 140 in a manner know in the art until the adhesive 140 cures.

Figure 7:
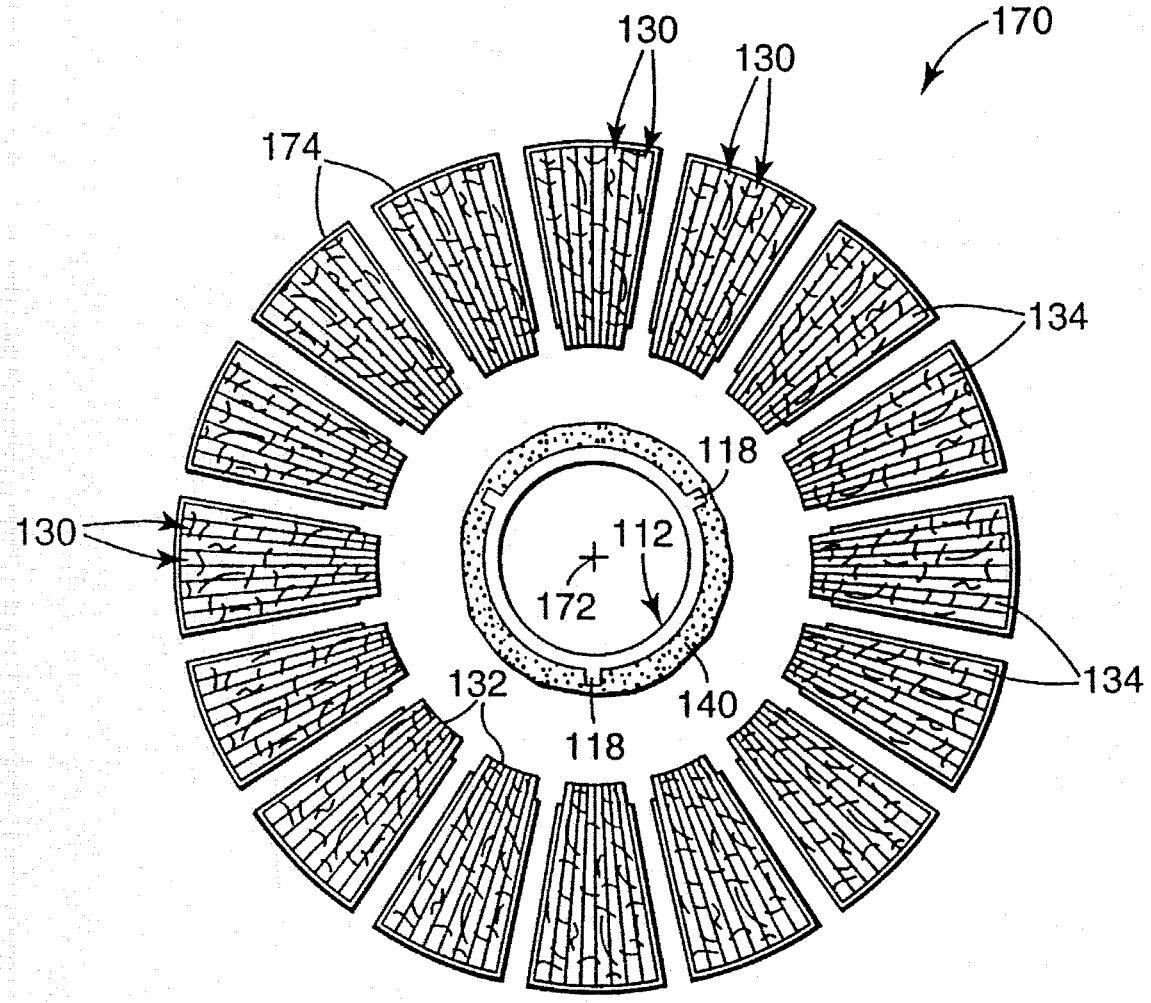
FIG. 7 is an end view of the core of FIG. 5 showing the attachment of the abrasive flaps to the core.
Figure 9:
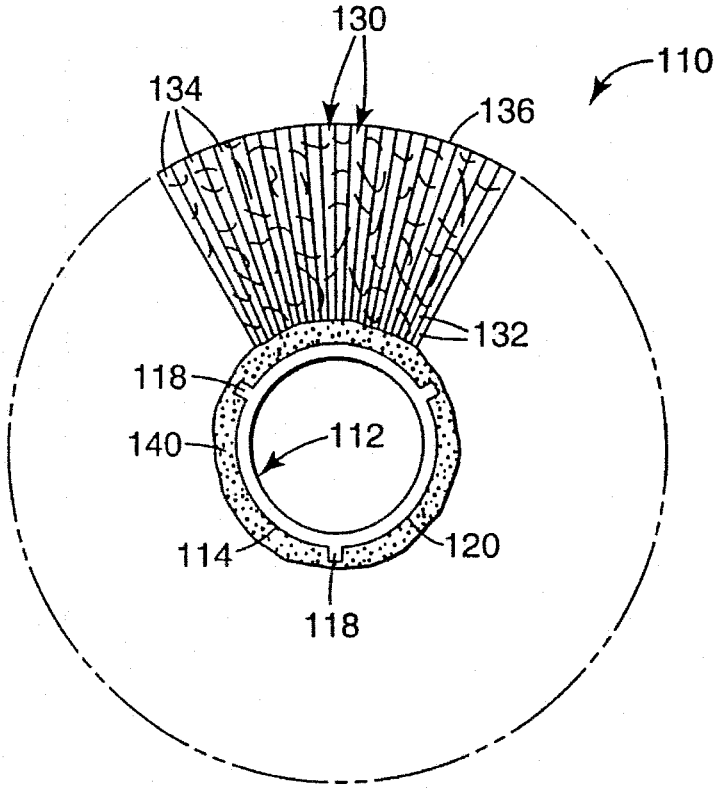
FIG. 9 is a side view of an assembled flap brush in accordance with the present invention.

Another preferred method and apparatus for assembling flaps 130 is seen in FIG. 7. Former 170 includes any suitable number of flap trays 174 uniformly arranged around central axis 172. When making an abrasive flap brush having an outer diameter of approximately 15.2 cm (6 in) to 20.3 cm (8 in), it has been found useful to employ sixteen trays 174, each holding eight flaps 130 for a total of one hundred and twenty-eight flaps on a flap brush 110. The trays 174 are at least long enough to hold the flaps 130, and may, for example, be 1.32 meters (52 in) long. Trays 174 are removed from former 170 and loaded with flaps 130. The flaps 130 are inserted into the trays 174 with core ends 132 extending from the tray and outer ends 134 held within the tray. The trays are then returned to former 170. The trays initially are far enough apart from central axis 172 to allow a core 112 coated with adhesive 140 to be placed in the center of the former 170 along axis 172. Each tray is connected to a suitable drive means (not shown) which moves the trays radially into contact with the core, simultaneously compressing the core ends 132 of the flaps in the circumferential direction. The trays 174 may be rectangular in cross-section, in which case they must be flexible enough to be deformed to a wedge-shaped cross section when driven to hold the flaps against the adhesive. Such a configuration allows the flaps to be easily loaded onto the trays. Alternatively, the trays may initially be wedge-shaped as illustrated. When using one hundred and twenty eight nonwoven abrasive flaps of the size described above to fabricate an abrasive flap brush having an outer diameter of 15.2 *cm* (6 in), the flaps are compressed at their core ends 132 to about 10% of their uncompressed thickness, and are compressed at their outer ends 134 to about 30% of their uncompressed thickness. It will be recognized, however, that the flaps may be compressed more or less depending on several factors such as the intended application of the abrasive flap brush, on the size of the assembled flap brush, and on the number, type, grade and dimensions of the flaps. The trays maintain the flaps against the core until the adhesive 140 sets. An assembled abrasive flap brush 110 constructed in accordance with the foregoing embodiment is illustrated in FIG. 9.

Figure 8:
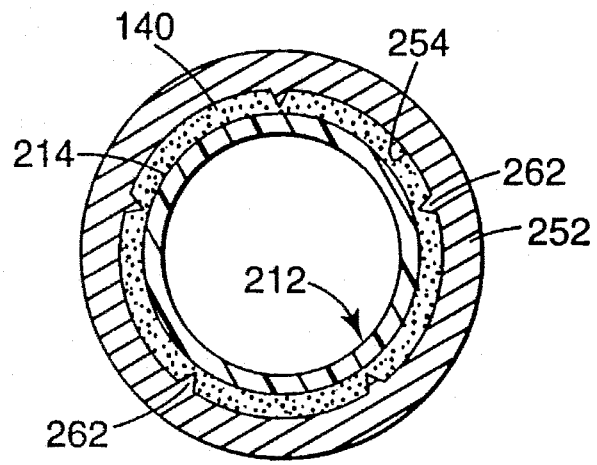
FIG. 8 is a view like FIG. 6 of a second embodiment of the present invention.

FIG. 8 illustrates another embodiment of the present invention, in which the spacing means is included in the adhesive coater. Bore 252 of the coater includes spacing projections 262 extending radially from the wall 254 towards the center of the bore to guide core 212 as it is passed through the bore 252. In the illustrated embodiment, five triangular projections 262 are evenly spaced about the bore. In a manner similar to the spacing projections 118 provided on core 112 in the previously described embodiment, spacing projections 262 maintain a predetermined minimum distance between core outer surface 214 and the wall 254 of the bore 252 to ensure that a sufficiently uniform layer of adhesive 140 is provided on the outer surface 214 of the core 212. After the outer surface 214 of the core 212 has been coated with adhesive 140, the abrasive flaps 130 may be adhered to the core 212 in the manner described above with respect to the previous embodiment.

Figure 10:
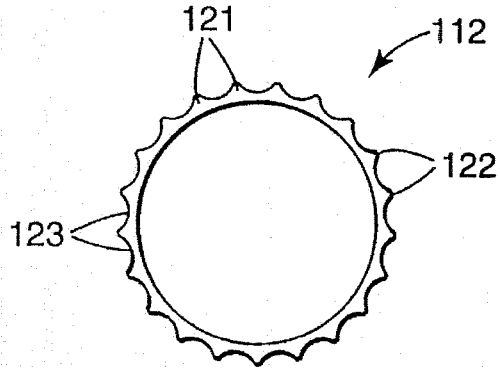
FIGS. 10–12 are side views of alternate embodiments of the flap brush core of the present invention.
Figure 11:
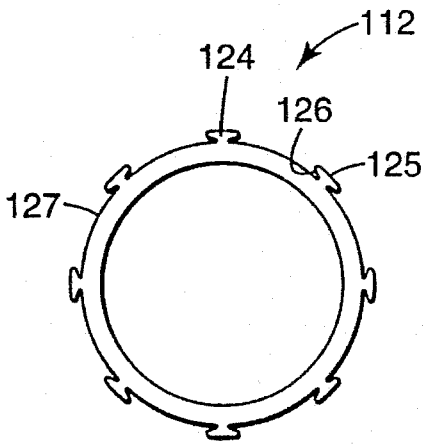
Figure 12:
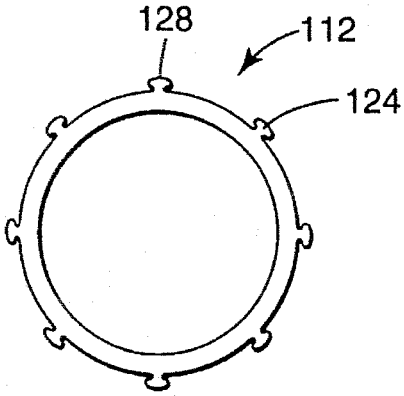

In any of the embodiments described herein, the spacing means may be of any cross-sectional shape, provided that they maintain the necessary spacing between the inner wall of the bore which serves as the operative surface of the coater, and the outer surface of the core to ensure adequate adhesive is coated onto the outer surface of the bore, even when the core is not truly concentric in the bore, or when the core is out-of-round. However, the spacing means should not be so large individually or in total to interfere with coating an adequate amount of adhesive 140 onto the outer surface of the core. Examples of other preferred cross-sectional shapes of the spacing projections include scallop shaped projections as seen in FIG. 10, or mushroom shaped projections as seen in FIG. 11. Scallop shaped projections 121 include peaks 122 and valleys or adhesive reservoirs 123. The peaks 122 will maintain a desired minimum gap between the core 112 and coater bore 152 to ensure adequate adhesive is coated into the valleys 123. With mushroom shaped projections 124, the top surface 125 will contact the bore to maintain a desired minimum spacing, ensuring adequate adhesive is coated in adhesive reservoirs 127. To reduce the area of the spacing projection which contacts the wall of the bore, top 125 may be modified to have a more pronounced peak 128 as seen in FIG. 12. An additional benefit of a projection such as the mushroom shaped projection is the presence of an undercut portion 126 that will provide a secure mechanical interlock between the core and the adhesive. Although it is possible to have a single spacing projection, there are preferably at least two spacing projections, and more preferably three or more projections are included. Also, the projections may be discrete (such as bumps) rather than continuous, and need not be linear along the length of the core or the bore (such as helical or wavy projections). The spacing projections may or may not be evenly spaced about the core in the first embodiment, or about the bore in the second embodiment. The spacing means may be included on either or both the core and bore.

Whether the spacing projections are present on the core 112 or the coater 250, it is important that they be configured to allow a sufficiently uniform coating of adhesive to be applied to the outer surface of the core, even when the core is not concentric to the bore, or when the core is out-of-round, or both. When the spacing projections are provided on the core 112, the projections will ensure a substantially uniform layer of adhesive 140 is applied at least to the portions of the outer surface 114 between the projections, even if the projections contact the bore during application of the adhesive. Those portions of the outer surface between the projections thus serve as adhesive reservoirs and are illustrated as adhesive reservoir 120 in FIG. 6; valley, or adhesive reservoir 123 in FIG. 10; and adhesive reservoir 127 in FIG. 11. Although little or no adhesive may initially be coated onto to the top of the projections which contact the bore, the adhesive applied in the adhesive reservoirs between the spacing projections will be forced onto the top of the projections when the flaps are pressed into contact with the bore. This will ensure adequate bonding of substantially all of the flaps. Similarly, if a projection 262 extending from the bore of the coater contacts a portion of the outer surface of the core, that portion will receive little or no adhesive in a local area. Pressing the flaps into contact with the core will force the adhesive to fill into the portions of the core contacted by the bore projections, allowing adequate bonding of substantially all of the flaps.

It is preferred that the spacing means not all simultaneously contact the wall 154 of the bore 152 in the first embodiment, or the outer surface 214 of the core 212 in the second embodiment, because little or no adhesive 140 would adhere to the contact areas. Instead, it is preferred that the diameter of the bore, core, and spacing means be selected to allow clearance between the spacing means and the opposed surface when the core is centered within the bore and the core is not out-of-round. Under these circumstances, adhesive will be applied reservoir portions of the outer surface 114 and the outermost surfaces of the spacing projections on core 112. It is also preferred that the adhesive 140 be selected to adhere to the core without dripping off or migrating along the core due to gravity. The adhesive 140 should have a sufficiently high viscosity and short cure time to prevent excessive movement of the adhesive 140 prior to the adherence of the abrasive flaps 130 to the core. The core optionally may be rotated about its longitudinal axis while adhesive is applied by the adhesive coater, to spread adhesive over the peripheral surface of the core.

The operation of the present invention will be further described with regard to the following detailed examples. These examples are offered to further illustrate the various specific and preferred embodiments and techniques. It should be understood, however, that many variations and modifications may be made while remaining within the scope of the present invention.

EXAMPLE 1

An abrasive flap brush 110 was provided according to the present invention as follows. A glass fiber/polyester composite core 112 having an inner diameter of 5.1 cm (2 in) and an outer diameter initially of 6.0 cm (2.375 in) was provided with 21 spacing projections 121 by machining 21 grooves parallel to the longitudinal axis of the core and evenly spaced about the circumference of the core, as shown generally in FIG. 10. The grooves were formed with a 1.27 cm (0.5 in) wide end mill having a 0.64 cm (0.25 in) cutting radius. The grooves were each approximately 0.24 cm (0.094 in) deep at the center. The finished core had a cylindrical inner surface and a scalloped outer surface with a thickness varying from peak to valley of the scallops of approximately 0.476 cm (0.188 in) to 0.238 cm (0.094 in). The peaks of the scallops were each less than 0.318 cm (0.125 in) wide in the circumferential direction. The core was 1.42 m (56 in) long.

A funnel-shaped adhesive coater as described above comprising a funnel portion and a cylindrical bore portion was provided. The funnel portion was large enough to hold sufficient adhesive 140 to coat a core at least 2.29 m (90 in) long. The bore of the coater was 6.4 cm (2.5 in) diameter. The adhesive 140 was the above-described mixture of: 500 parts of Shell Epon® Resin 828 (bisphenol A/epichlorohydrin based epoxy resin) available from Shell Oil Co., Houston, Tex.; 500 parts of D.E.N.® 438 Epoxy Novolac (polymers of epichlorohydrin, phenolformaldehyde novolac) available from Dow Chemical, U.S.A., Midland, Mich; 1000 parts of Capcure 3-800 (mercaptan polymer) available from Henckel Corporation, Ambler, Pa; and 30 parts Capcure EH-30 (2,4,6,-tri (dimethylaminomethyl) phenol) available from Henckel Corporation. The adhesive coater was held stationary, and the core was passed through the bore by hand at a speed of approximately 0.3 m/sec (1 ft/sec). The core was intentionally held off-center relative to the bore such that the spacing projections on one side of the core continuously contacted the wall of the bore.

After the adhesive was applied, 128 abrasive flaps were provided. The abrasive flaps comprised a nonwoven abrasive material commercially available from Minnesota Mining and Manufacturing Company, St. Paul, Minn., under the trade designation Scotch-Brite™ type 7A Medium Cut & Polish Material. The flap material was cut to provide individual flaps approximately 1.27 m (50 in) long by 5.08 cm (2 in) wide by 1.27 cm (0.5 in) thick. Eight flaps were inserted in each of sixteen trays and then compressed and held in contact with the adhesive with a former as described above until the adhesive was sufficiently cured.

The resulting abrasive flap brush had a 15.24 cm (6 in) outer diameter and a core inner diameter of 4.58 cm (2 in). The assembled flap brush was cut into a plurality of flap brushes each 2.54 cm (1 in) wide. The flap brushes were visually inspected and used to abrade a surface, and all of the abrasive flaps were observed to be sufficiently adhered to the core.

EXAMPLE 2

The flap brush of Example 2 was fabricated by the same process as the flap brush of Example 1 except for the spacing projections provided on the core. A core having an inner diameter of 5.1 cm (2 in) and an outer diameter initially of 6.0 cm (2.375 in) was machined to remove about 1.6 mm (0.063 in) of material from the outer surface except for three generally rectangular spacing projections 118 formed from the uncut material, as seen generally in FIGS. 5–7. The projections were each approximately 1.6 mm (0.063 in) high, 3.2 mm (0.125 in) wide along the circumference of the core, and extended for the full length of the core, 1.42 meters (56 in). The projections were spaced approximately 120 degrees apart. The core was held off-center relative to the adhesive coater such that the top surface of two of the projections continuously contacted the bore of the coater and therefore were not coated with adhesive. However, sufficient adhesive was coated on the entire portion of the outer surface between the spacing projections. This provided sufficient adhesive such that when the abrasive flaps were pressed into place, adhesive was displaced and flowed about the entire circumference, such that all of the abrasive flaps were adequately adhered to the core. The long flap brush was then cut into a plurality of flap brushes each 2.54 cm (1 in) wide. The flap brushes were visually inspected and used to abrade a surface, and all of the abrasive flaps were observed to be sufficiently adhered to the core.

EXAMPLE 3

The flap brush of Example 3 was fabricated by the same process as the flap brushes of Examples 1 and 2, except for the spacing projections provided on the core. The projections of Example 3 were formed by pultrusion, using a die which formed eight spacing projections having a "mushroom shape" as shown generally in FIG. 11. The spacing projections each extended about 1.22 mm (0.063 in) high from the outer surface of the core, were about 4.8 mm (0.188 in) wide at their widest point, and extended the full length of the core. The undercut of the mushroom had a radius of curvature of about 0.41 mm (0.016 in). The core was held off-center relative to the adhesive coater such that the projections on one side of the core continuously contacted the wall of the bore of the coater. The long flap brush was then cut into a plurality of flap brushes each 2.54 cm (1 in) wide. The flap brushes were visually inspected and used to abrade a surface, and all of the abrasive flaps were observed to be sufficiently adhered to the core.

The present invention has now been described with reference to several embodiments thereof. The foregoing detailed description and examples have been given for clarity of understanding only. No unnecessary limitations are to be understood therefrom. It will be apparent to those skilled in the art that many changes can be made in the embodiments described without departing from the scope of the invention. Thus, the scope of the present invention should not be limited to the exact details and structures described herein, but rather by the structures described by the language of the claims, and the equivalents of those structures.

What is claimed is:

1. A method of making an abrasive flap brush, comprising the steps of:

a) providing a central core including an outer surface, a first end, and a second end;

b) placing said first end of said core in a coater including a bore, said bore including an inner wall configured to extend around said outer surface;

c) introducing adhesive into said bore;

d) moving said core from said first end to said second end through said bore thereby coating said outer surface with said adhesive; and e) adhering a plurality of abrasive flaps to said core with said adhesive; wherein at least one of said outer surface and said inner wall includes a spacing means for maintaining a predetermined minimum distance between said outer surface and said inner wall.

2. The method of claim 1, wherein said spacing means comprises a plurality of spacing projections extending from at least one of said outer surface and said inner wall.

3. The method of claim 2, wherein said spacing means comprises a plurality of spacing projections extending from said outer surface of said core.

4. The method of claim 3, wherein said core is a cylindrical core.

5. The method of claim 4, wherein said outer surface comprises adhesive reservoirs between said spacing projections for receiving said adhesive.

6. The method of claim 4, wherein said spacing projections comprise a plurality of generally rectangular projections extending radially outwardly from said outer surface.

7. The method of claim 4, wherein said spacing projections comprise a plurality of scallop-shaped projections, each of said scallop-shaped projections including a concave adhesive reservoir bounded on each side by a peak.

8. The method of claim 4, wherein said spacing projections comprise a plurality of mushroom-shaped projections, each of said projections including a top surface remote from said outer surface and an undercut portion between said top surface and said outer surface.

9. The method of claim 4, wherein said outer surface comprises a circumference and said spacing projections are evenly angularly spaced about said circumference.

10. The method of claim 4, wherein said cylindrical core includes a longitudinal axis and said spacing projections extend parallel to said longitudinal axis.

11. The method of claim 10, wherein said spacing projections extend from said first end to said second end of said core.

12. The method of claim 1, wherein said core is cylindrical, said flaps include a core end adhered to said core and an outer end opposite said core end, and said adhering step includes adhering a sufficient number of abrasive flaps to said core such that said outer ends comprise a generally cylindrical peripheral abrading surface.

13. The method of claim 1, wherein said abrasive flaps comprise nonwoven abrasive flaps.

14. The method of claim 13, comprising the further steps of compressing said nonwoven abrasive flaps and maintaining said flaps compressed while adhering said flaps to said core.

15. The method of claim 1, wherein said abrasive flaps comprise coated abrasive flaps.

16. The method of claim 1, wherein said abrasive flaps comprise nonwoven abrasive flaps and coated abrasive flaps.

17. The method of claim 2, wherein said spacing means comprises a plurality of spacing projections extending radially from said inner wall of said bore towards said outer surface of said core.

18. The method of claim 17, wherein said bore is cylindrical, said inner wall comprises a circumference, and said spacing projections are evenly angularly spaced about said circumference.

19. The method of claim 17, wherein said bore includes a longitudinal axis and said spacing projections extend parallel to said longitudinal axis.

20. The method of claim 19, wherein said spacing projections extend for the length of the bore.

21. An abrasive flap brush produced by the method of claim 1.

22. An abrasive flap brush of the type including a core having a layer of adhesive applied by the operative surface of a coater, said abrasive flap brush comprising:

a core including an outer surface;

a layer of adhesive provided on said outer surface; and a plurality of abrasive flaps adhered to said core by said layer of adhesive;

wherein said core includes spacing means on said outer surface for maintaining a predetermined minimum distance between said core outer surface and the operative surface of the coater thereby allowing a sufficiently uniform layer of said adhesive to be applied to said outer surface such that substantially all of said abrasive flaps are adhered to said core.

23. An abrasive flap brush as in claim 22, wherein said spacing means comprises a plurality of spacing projections extending from said outer surface.

24. An abrasive flap brush as in claim 23, wherein said outer surface comprises a plurality of adhesive reservoirs between said projections, such that said adhesive layer is provided at least to said adhesive reservoirs.

25. An abrasive flap brush as in claim 23, wherein said core is cylindrical.

26. An abrasive flap brush as in claim 25, wherein said spacing projections comprise a plurality of generally rectangular projections extending radially outwardly from said outer surface.

27. An abrasive flap brush as in claim 25, wherein said spacing projections comprise a plurality of scallop-shaped projections, each of said scallop-shaped projections including a concave adhesive reservoir bounded on each side by a peak.

28. An abrasive flap brush as in claim 25, wherein said spacing projections comprise a plurality of mushroom-shaped projections, each of said projections including a top surface remote from said outer surface and an undercut portion between said top surface and said outer surface.

29. An abrasive flap brush as in claim 25, wherein said outer surface comprises a circumference and said spacing projections are evenly angularly spaced about said circumference.

30. An abrasive flap brush as in claim 25, wherein said core includes a longitudinal axis and said spacing projections extend parallel to said longitudinal axis.

31. An abrasive flap brush as in claim 30, wherein said spacing projections extend for the length of the core.

32. An abrasive flap brush as in claim 25, wherein said abrasive flaps comprise a core end adhered to said core and an outer end opposite said core end, and wherein a sufficient number of abrasive flaps are adhered to said core such that said outer ends comprise a generally cylindrical peripheral abrading surface.

33. An abrasive flap brush as in claim 22, wherein said core is constructed from a material comprising a polyester/glass fiber composite.

34. An abrasive flap brush as in claim 22, wherein said adhesive is selected from the group consisting of epoxies, phenolics, silicones, acrylics, and styrene-butadiene copolymers.

35. An abrasive flap brush as in claim 22, wherein said abrasive flaps comprise nonwoven abrasive flaps.

36. An abrasive flap brush as in claim 35, wherein said nonwoven abrasive flaps comprise staple fibers, abrasive particles, and a curable binder.

37. An abrasive flap brush as in claim 35, wherein said nonwoven abrasive flaps are compressed.

38. An abrasive flap brush as in claim 22, wherein said abrasive flaps comprise coated abrasive flaps.

39. An abrasive flap brush as in claim 22, wherein said abrasive flaps comprise coated abrasive flaps and nonwoven abrasive flaps.

* * * * *